US005395022A

United States Patent [19]

Vandewall

[11] Patent Number: 5,395,022

[45] Date of Patent: Mar. 7, 1995

[54] BELT ATTACHED BAG FOR TENNIS BALLS

[76] Inventor: Dolly C. Vandewall, P.O. Box 3989, Midway, Wash. 98032

[21] Appl. No.: 233,031

[22] Filed: Apr. 25, 1994

Related U.S. Application Data

[63] Continuation of Ser. No. 797,390, Nov. 25, 1991, abandoned.

[51] Int. Cl.[6] ..... A45F 3/00

[52] U.S. Cl. ..... 224/226; 224/224; 224/919

[58] Field of Search ..... 224/919, 224, 226, 227, 224/228, 253

[56] References Cited

U.S. PATENT DOCUMENTS

| | | | |
|---|---|---|---|
| 4,079,871 | 3/1978 | Sica | 224/226 |
| 4,433,803 | 2/1984 | Liberboim | 224/919 |
| 4,836,427 | 6/1989 | McManus | 224/919 |

FOREIGN PATENT DOCUMENTS

| | | | |
|---|---|---|---|
| 2491343 | 4/1982 | France | 224/224 |
| 2712090 | 9/1978 | Germany | 224/226 |

*Primary Examiner*—Linda J. Sholl

*Attorney, Agent, or Firm*—Christensen, O'Connor, Johnson & Kindness

[57] ABSTRACT

The bag is pliable, essentially rectangular in all views and has an open top. The length of the top is a multiple of its width in the range of 2 to 8, the width being approximately equal to the diameter of a tennis ball. One of the long edges of the top is elasticized. A belt is attached to the other side and the two ends with portions extending from the ends to encircle the user's waist. These portions are adjustably detachably attachable to hold the belt and the bag in place on the user. The material of the belt is stiff enough to tend to keep the open top of the bag open to facilitate insertion and removal of tennis balls but compliant enough to limit the bag's interference with the activity of the user. The bag is designed to be worn with the elasticized long edge of the top next to the wearer of the bag.

3 Claims, 1 Drawing Sheet

BELT ATTACHED BAG FOR TENNIS BALLS

This application is a continuation application based on prior application Ser. No. 07/797,390, filed on Nov. 25, 1991, now abandoned.

BACKGROUND OF THE INVENTION

1. Field

The subject invention is in the field of articles attachable to a person's body to enable or facilitate carrying other articles. Specifically it is in the field of such articles which are attached by a belt and, more specifically, by a belt which is part of the attached article.

2. Prior Art

The closest known prior art to the subject invention is a pouch attached to a user by a strap or belt. The belt is provided with the pouch and may or may not be detachable from it and the belt is adjustable. This prior art item is not known to be patented and is known in the trade as a tote or fanny pack. There is not known to be any commercially available tote adapted to carrying a supply of tennis balls and the primary objective of the subject invention is to provide such an article. Other objectives are that the article be comfortable to use and cause a minimum of interference with the activity of a user relative to the number of tennis balls being carried.

SUMMARY OF THE INVENTION

The subject invention is an open topped fabric bag, essentially quadrangular in all views. The open top is essentially rectangular with two sides and two ends, the sides being several times longer the the ends. A fabric belt is attached to the top of the bag along one end, then one side and then the other end. The other side of the top is elasticized. In its relaxed state it is shorter than the side attached to the belt and it can be stretched to be longer the the side attached to the belt.

In use the ends of the belt extending from the bag are adjustable and detachably attached to each other around the user's waist with the elasticized side of the top against the user and stretched to make its length essentially equal to the length of the side of the top attached to the belt. In effect, the elasticized side can be termed a structural short circuit of the portion of the belt attached to the ends and side of the bag. Attached in this way on the user's hip, the bag conforms to the user's body and the stiffness of the belt tends to hold the top open enough to facilitate placing tennis balls into the bag and removing them one or two at a time for use.

The invention is described in more detail below with reference to the attached drawings.

DETAILED DESCRIPTION OF THE INVENTION

Figure 1:
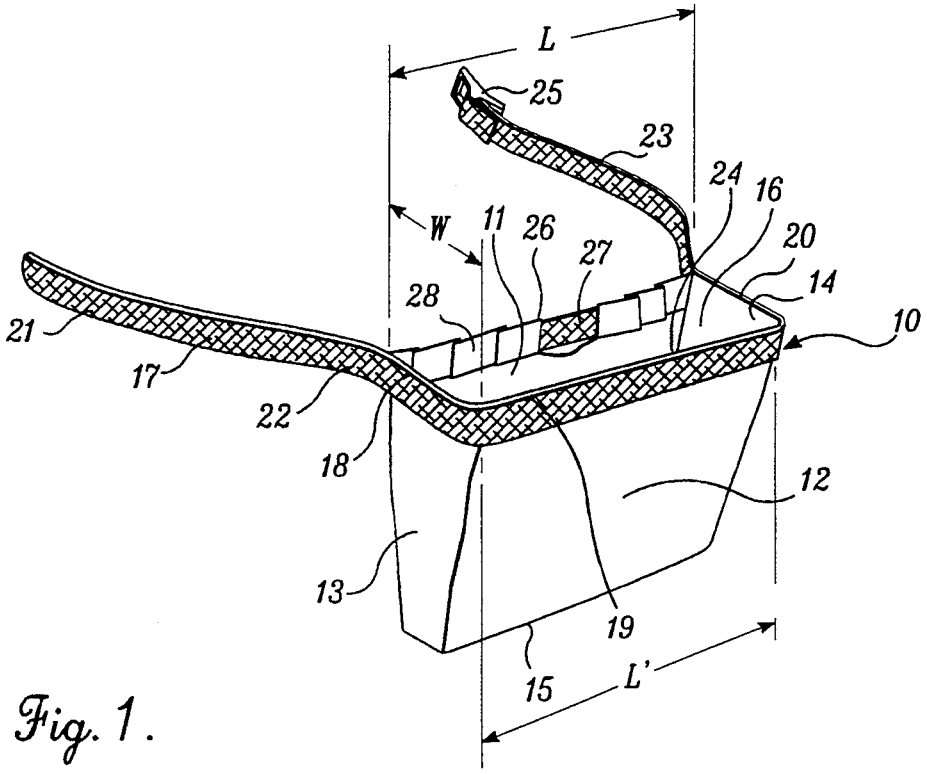
FIG. 1 is a perspective view of the bag.

The subject invention is a belt attached bag for carrying a supply of tennis balls. Referring to FIG. 1, the bag 10 comprises four sided panels, i.e. sides 11 and 12, ends 13 and 14 and bottom 15, not visible in this view. The bag has an opening 16 at its top. A portion of belt 17 is attached at top edges 18, 19 and 20 of end 13, side 12 and end 14 respectively, the edges of these ends and side forming a non-elasticized portion of the edge of the open top of the bag. Another portion 21 of the belt extends from end 22 of the belt portion attached to end 13 of the bag and portion 23 extends from end 24 of the belt attached to end 14 of the bag. Portions 21 and 23 are adjustably and detachably attachable using buckle 25. Top edge 26 of side 11 is elasticized, in this embodiment by an elastic strap 27 enclosed in hem 28, edge 26 forming an elasticized portion of the open top. Length 1 of edge 26 is less than length 1' of edge 19 when the elastic strap is relaxed and may increase to be greater than length 1' when stretched by the adjustment of the belt ends attachment. Length 1 is a multiple of width w in the range of 2 to 8 and width w is approximately equal to the diameter of a tennis ball.

Figure 2:
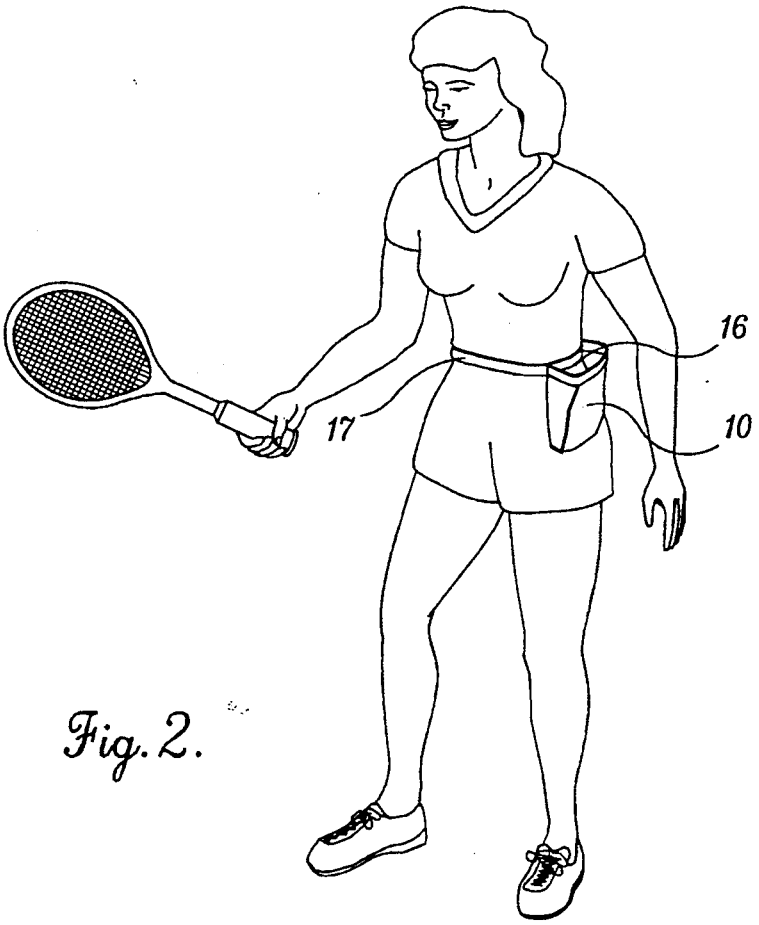
FIG. 2 illustrates the bag being worn and ready for use.

In use, as shown in FIG. 2, belt 17 is attached around a user's waist and adjusted so that lengths 1 and 1' are essentially equal. The stiffness of the belt material is such that it tends to keep opening 16 open but also deflects easily to essentially avoid interference with the user's actions by the bag. The bag is provided in a series of sizes with capacities ranging, for example, from 10 to 20 tennis balls. The bag is intended for use during practice which is facilitated by having a supply of tennis balls immediately at hand.

It is considered to be understandable from this description that the invention meets its objectives. It provides a tote adapted to carrying a supply of tennis balls. It is comfortable in use because of the elasticity of the top edge of the side of the bag next to the user's body. The compliance of the top edges of the bag relieve any interference the bag might offer to the user's actions while facilitating use of the bag by keeping its top generally open.

It is also considered to be understood that while one embodiment of the invention is described herein, other embodiments and modifications of the one described are possible within the scope of the invention which is limited only by the attached claims.

I claim:

1. A tennis ball carrier to be worn by a wearer, the carrier comprising:

a. a pliable bag portion comprising a nominally open top opening cooperatively defined by a first side edge, a second side edge spaced from the first side edge, and first and second end edges interconnecting the ends of the first and second side edges;

b. the first side edge of the bag portion being elasticized to form gathers along the length of the first side edge and cause the first side edge to assume a nominal length shorter than if stretched to its full length, and the second side edge, first end edge and second end edge being non-elasticized; and, c. a belt portion for attaching the tennis ball carrier to the waist of the wearer, the belt portion comprising:

a belt intermediate section fixed to and extending along the lengths of the first end edge, the second side edge and the second end edge of the bag portion to sufficiently increase the rigidity of the first end edge, second side edge and second end edge to cause the first end edge, second side edge and second end edge to maintain their spaced relationship and orientation relative to each other when the ball carrier is worn by the wearer with the first side edge disposed against the body of the wearer;

a belt first end section extending from the bag portion adjacent the intersection of the first end edge and the first side edge of the bag portion;

a belt second end section extending from the bag portion adjacent the intersection of the second end edge and the first side edge of the bag portion; and, means for attaching the free ends of the first and second end sections of the belt portion together when the belt portion is wrapped around the waist of the wearer with the first side edge against the wearer's body, whereby the first and second end edges extending outwardly from the wearer's body and the second side edge disposed outwardly from the wearer's body, whereby the first and second side edges and the first and second end edges cooperatively form a nominally open top of sufficient resiliency to deflect so as to avoid interference with the wearer's action when playing tennis.

2. The tennis ball carrier of claim 1, wherein the first side edge of the bag portion is nominally shorter in length than the length of the second side edge of the bag portion.

3. The tennis ball carrier of claim 2, wherein the intermediate section of the belt is continuous.

* * * * *